United States Patent [19]

Frazier

[11] 4,344,548

[45] Aug. 17, 1982

[54] PUMP DISPENSERS FOR CONTAINERS

[75] Inventor: Albert A. Frazier, Nashville, Tenn.

[73] Assignee: Aladdin Industries, Incorporated, Chicago, Ill.

[21] Appl. No.: 191,325

[22] Filed: Sep. 26, 1980

Related U.S. Application Data

[63] Continuation of Ser. No. 973,752, Dec. 28, 1978, abandoned, which is a continuation-in-part of Ser. No. 901,297, May 1, 1978, abandoned.

[51] Int. Cl.[3] ..... F04B 43/02; B65D 47/34; B67D 5/42; B67D 5/54

[52] U.S. Cl. ..... 222/209; 222/211; 222/400.8; 222/401

[58] Field of Search ..... 222/400.8, 383, 209, 222/402, 211, 285, 131, 401, 397; 417/118

[56] References Cited

U.S. PATENT DOCUMENTS

| | | | |
|---|---|---|---|
| 890,153 | 6/1908 | Mastin | 222/401 |
| 2,069,383 | 2/1937 | Nedbalek | 222/401 |
| 2,154,393 | 4/1939 | Bates | 222/397 |
| 2,382,314 | 8/1945 | Herb | 222/401 X |
| 4,113,147 | 9/1978 | Frazier et al. | 222/401 X |

FOREIGN PATENT DOCUMENTS

| | | | |
|---|---|---|---|
| 1173836 | 3/1959 | France | 417/118 |

*Primary Examiner*—David A. Scherbel
*Attorney, Agent, or Firm*—McDougall, Hersh & Scott

[57] ABSTRACT

Pump dispensers dispense liquids from the interior of a container without the need for removing the top. The pump dispenser employs a manually operated disk to which a diaphragm is attached to force air from an air chamber into the container interior where it displaces the liquid contents forcing them up a fluid tube and out a spout. A valve seals the air chamber except during pumping to prevent the entry of liquids into the air chamber.

4 Claims, 7 Drawing Figures

PUMP DISPENSERS FOR CONTAINERS

This is a continuation of Ser. No. 973,752, filed Dec. 28, 1978, now abandoned, which is a continuation-in-part of Ser. No. 901,297, filed May 1, 1978, now abandoned.

BACKGROUND OF THE INVENTION

This invention relates to the field of insulated containers, such as thermos bottles, foam bottles and the like. More specifically, it relates to an improvement whereby the need to remove a cap and tip the container to dispense a liquid is avoided. Since the purpose of an insulated bottle is to maintain its contents at a desired serving temperature, either hot or cold, it is desirable to maintain the thermal integrity of the container to prevent heat loss or gain.

Prior container designs, whether wide mouth or narrow mouth in construction, have usually required that a cap be removed and the bottom be tipped to some degree to pour the contents from the bottle. During this dispensing operation the insulating properties of the bottle are impaired. Another disadvantage of prior designs is that during pouring it is easy to spill the contents and if the liquid is hot, burns can result. The present invention provides a dispenser pump which avoids the necessity for opening and pouring to dispense the contents of the container and which, therefore, maintains the integrity of a temperature insulating container.

Pump units for insulated bottles have been developed by others. Some of these devices are highly complex employing a great number of components and being relatively more expensive to manufacture than the present invention. Others, while low in cost and simple in design, do not fully prevent the entry of liquid into the air chamber which is undesirable as it impairs pump operation.

It is accordingly an object of the invention to provide a simple low cost pump unit for a container which employs a relatively small number of components to accomplish its fluid pumping function.

Another object of the invention is the provision of a pump dispenser for a container which prevents the entry of liquid from the container into the air chamber of the pump mechanism.

A further object is the provision of a pump dispenser for an insulating container which can be utilized in place of a cap.

Other objects and advantages of the invention will be apparent from the remaining portion of the specification.

PRIOR ART STATEMENT

In accordance with the provisions of 37 CFR 1.97, applicants state the closest prior art of which they are aware is the "PUMP-A-DRINK" dispenser manufactured and sold by Aladdin Industries, Incorporated, of Nashville, Tenn. That dispenser is disclosed and claimed in U.S. Pat. No. 4,113,147 which issued Sept. 12, 1978. The "PUMP-A-DRINK" dispenser employs a construction similar to that disclosed in the present invention but does not employ a valve and valve stem for affirmatively sealing the air chamber to prevent the entry of liquid into the air chamber. Other prior art of which applicants are aware include a number of prior art patents disclosed in the prior art statement of the aforementioned U.S. Pat. No. 4,113,147, which statement is hereby incorporated by reference.

DETAILED DESCRIPTION

Figure 1:
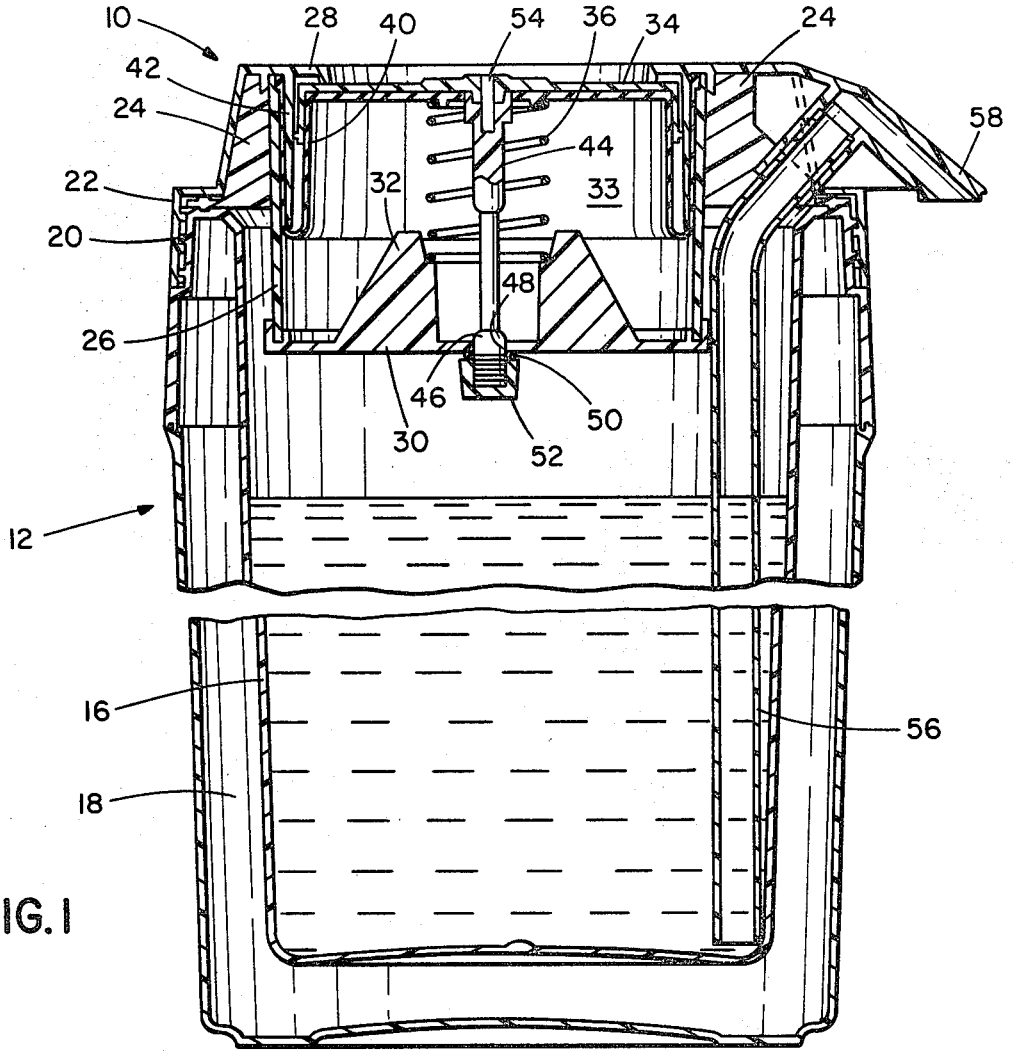
FIG. 1 is a cross-sectional view of a pump dispenser according to a first embodiment of the invention in an unactuated position.
Figure 2:
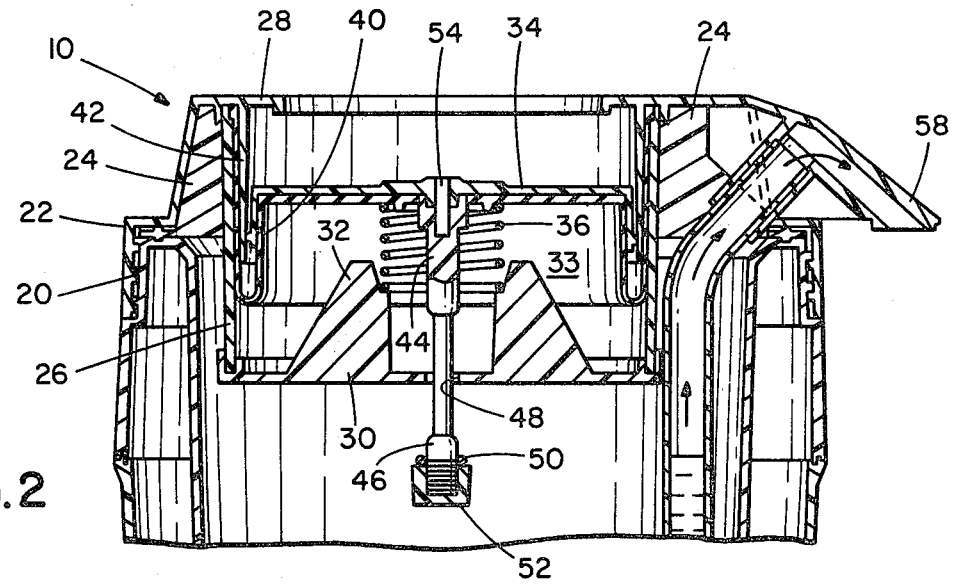
FIG. 2 is a partial view similar to FIG. 1 of the dispenser in the actuated position.

Referring now to FIGS. 1 and 2, the invention according to a first embodiment is illustrated. The invention is a pump unit 10 adapted to dispense liquids from the interior of an insulated container 12. Container 12 includes an outer jacket 14 and an inner jacket or liner 16. The outer jacket and liner define an insulating space 18 therebetween. The insulating space may be filled with foam, such as polyurethane or the like, or may otherwise be insulated in a conventional manner as, for example, by the use of a vacuum insulated filler.

It should be noted that throughout this description the pump unit will be described in conjunction with an insulated container since that is the most popular type sold. However, the unit is equally suitable for use with uninsulated containers, such as pitchers and carafes.

The pump unit 10 is releasably secured to the top of the container 12 over its pouring opening. The pump unit may be releasably secured by various well known conventional means as, for example, by providing threads 20 on the jacket 14 which are engaged by corresponding threads on the pump housing 22. In those applications where the pump unit is to be utilized with an insulated container, it is desirable to include insulation in the pump unit to reduce heat transfer from the unit. Accordingly, insulation 24 may be provided in the space between the housing 22 and a side wall 26 of the pump.

The pump unit includes the cylindrical side wall 26 secured at its top to the portion of the pump housing designated 28. The bottom of the side wall 26 is attached to a bottom element 30. The bottom element includes an upwardly extending conical portion 32.

The top portion of the housing designated 28 defines an annular opening into the interior of an air chamber 33 defined by the side walls 26 and bottom element 30. A disk 34 is positioned over the opening and retained against the top portion 28 by a coil spring 36. The spring is seated on the conical portion 32 of the bottom element and pushes upwardly against the disk. The disk is retained in the opening by virtue of the top portion 28 extending over the outer circumference of the disk.

In order to expel air from the chamber 33 a flexible, generally circular diaphragm 40 is provided. The outside edge of the diaphragm is secured to the housing by being compressed between an upper portion of side wall 26 and a securing rib 42 depending downwardly from the top portion 28. The diaphragm 40 extends downwardly from its point of securement and then doubles back upwardly and inwardly in contact with the underside of the disk and terminates at a point just short of the center of the disk.

Attached to the central portion of the disk is a valve stem 44. A valve 46 is provided on the lower end of the valve stem and passes through an opening 48 in the bottom 30. The opening 48 is of slightly larger diameter than the diameter of the valve stem. In order to seal the opening 48 when the unit is not in operation, thereby to prevent the entry of liquid from the container into the air chamber 33, a sealing arrangement is provided on the valve. This includes an O-ring or soft washer 50 and a cap 52 threadingly engaged on the end of the valve 46. The cap adjustably positions the O-ring or washer 50 to insure a tight seal over the opening 48 when the pump unit is in the unactuated position illustrated in FIG. 1. Removal of cap 52 permits replacement of the O-ring 50 if necessary.

An air channel 54 is provided through the center of the disk 34 and cooperates with a similar passage in the valve stem 44. These channels communicate the outside of the housing with air chamber 33 and permit entry of air into the chamber during the return stroke of the pump. The size and location of the channel 54 permits it to be closed off during pumping by the user placing a finger thereover.

Liquid in the container is dispensed during pumping via a hollow fluid tube 56 communicating the interior of the container with a dispensing spout 58. The tube is positioned upright within the container and terminates at a point near the bottom of the container interior. The upper end of the tube is secured to the pump housing 22 and the spout 58.

Operation of the pump unit illustrated in FIGS. 1 and 2 is as follows. The container 12 is filled with a liquid to be dispensed. The pump unit is then secured over the top of the container with the fluid tube extending into the container interior. To dispense the liquid the user places his index finger or thumb over the air channel 54 thereby to seal it and then depresses the disk 34 downwardly against the bias of spring 36 to the position illustrated in FIG. 2. This downwardly displaces the valve 46 and forces the air in the chamber 33 out the bottom opening 48 since the walls and flexible diaphragm 40 prevent the escape of air through any other passage.

Upon completing the downward pumping stroke the thumb or index finger is removed from the air channel 54 and the disk is released. This permits the spring 36 to return the disk to its original position while at the same time permitting air to enter the air chamber 33 in preparation for the next pumping operation.

As indicated in FIG. 2, the valve and O-ring do not protect the air chamber 33 against the entry of fluid during the pumping operation. However, this is not generally necessary inasmuch as the container must be upright to correctly dispense fluid through the spout 58. The greatest chance of fluid entering the pump unit occurs when the unit is not being utilized and, for example, is placed on its side. During such a period the unit would be in the condition illustrated in FIG. 1 and the valve 46 and O-ring 50 securely seal the air chamber 33 against the entry of the fluid from the container. This is highly desirable because it significantly reduces the cleaning requirements for the unit since the pump mechanism is unlikely to become clogged.

The pump unit illustrated in FIGS. 1 and 2 is suitable for containers, insulated or otherwise, which have a relatively wide opening at their top. Such is the case with many types of vacuum and foam insulated bottles currently on the market. A second type of insulated container which is often employed to store liquids, such as coffee or cold drinks, are containers which employ a relatively narrow opening at their top. According to a second embodiment of the invention a pump unit is provided having substantially the same attributes as the first embodiment but is capable of use with such a narrow mouth container.

Figure 3:
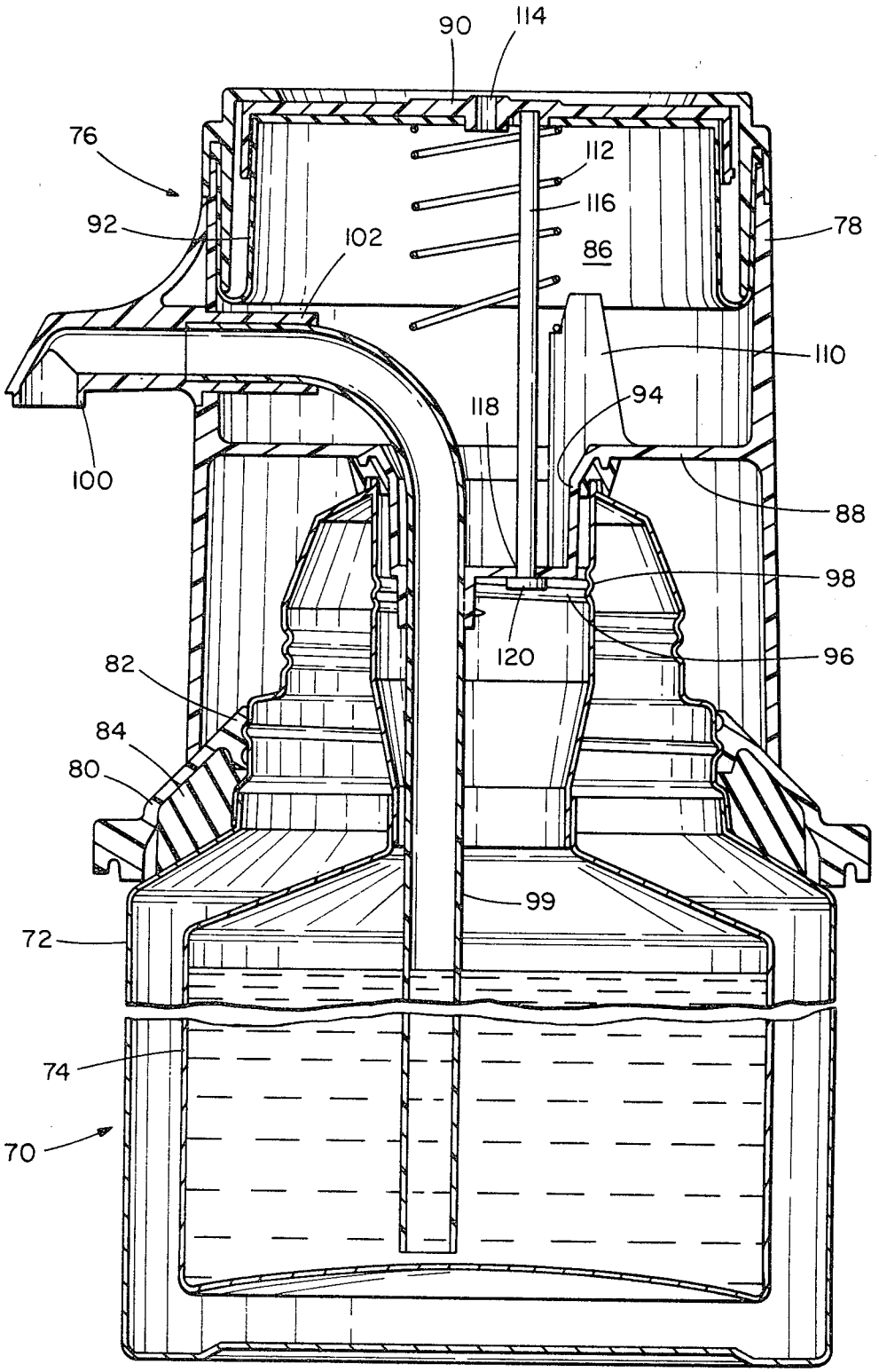
FIG. 3 is a cross-sectional view of a pump dispenser according to a second embodiment of the invention suitable for use with a narrow mouth container.
Figure 4:
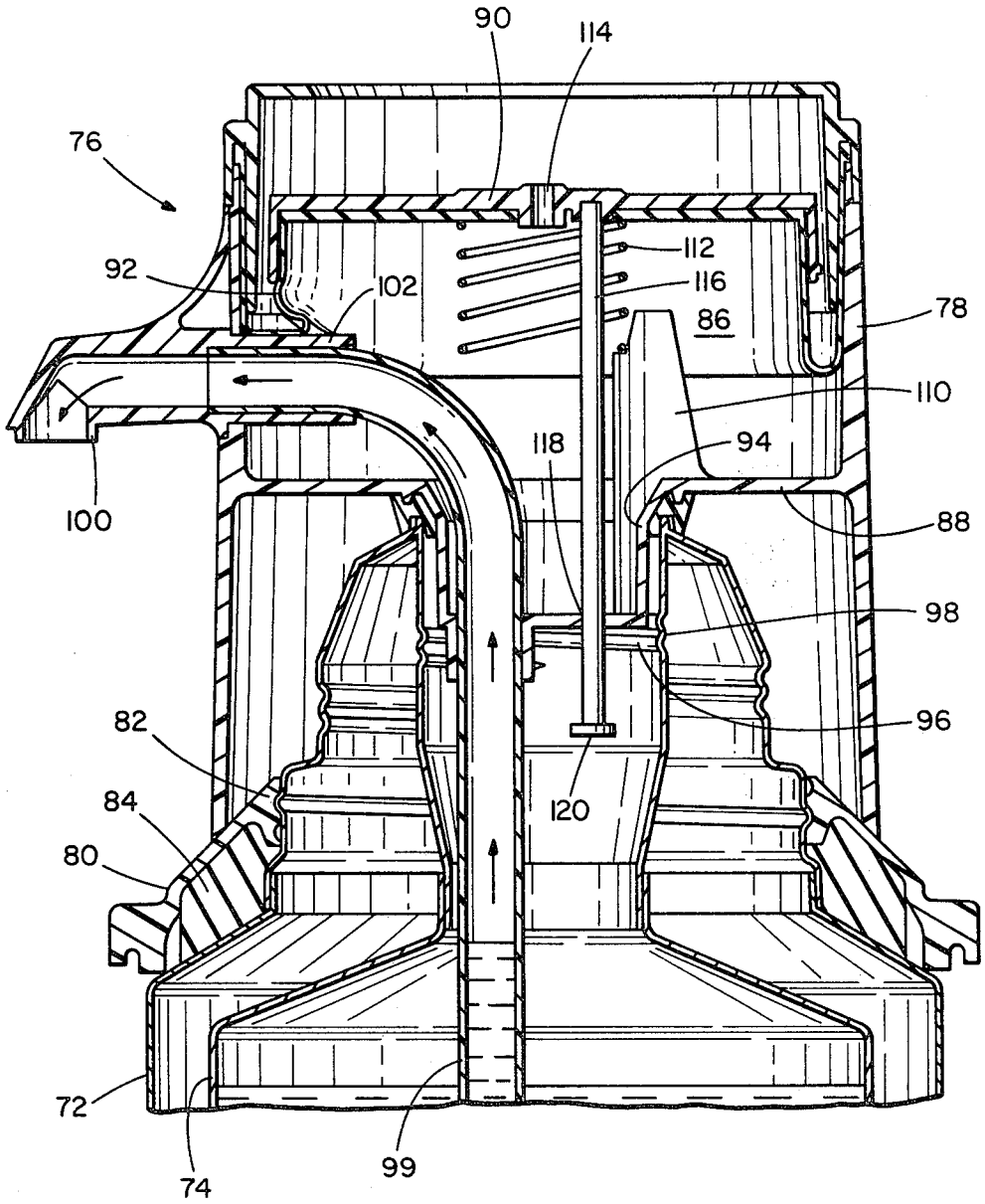
FIG. 4 is a view similar to FIG. 3 illustrating the second embodiment in the actuated position.

Referring now to FIGS. 3 and 4, a second embodiment of the invention is disclosed. In this embodiment a container 70 is provided with an outer jacket 72 and an inner liner 74. The space between the jacket and the liner may be provided with insulation or, in the case of a metal container, may be evacuated to form a vacuum insulated container commonly referred to as a "Stanley" bottle. The top of the container 70 tapers to form a narrow mouth opening to the container interior. A pump unit 76 according to the second embodiment is attached to the top of the container for dispensing fluid from the container without the need for pouring. The pump unit is provided with a side wall 78 of generally cylindrical construction. Attached to the bottom of the side wall is a breast piece 80 which includes means for engaging the outside of the container as, for example, the threads 82 illustrated. In the event that an insulated container is utilized, insulation 84 may be provided to reduce heat loss in the transition region.

As with the first embodiment the pump unit includes an air chamber 86 defined by a bottom wall 88, disk 90, flexible diaphragm 92 and the side wall 78. The bottom wall 88 includes a downwardly extending portion 94 adapted to be received within the opening of the container 70. As with the first embodiment, the bottom wall also includes an upwardly extending projection 110 which serves as a spring retainer for spring 112. Appropriate means may be provided for securing the portion 94 in the container opening as, for example, a threaded element 96 may be provided to engage similar threads 98 in the opening.

In this embodiment a fluid tube 99 is provided which extends from a point near the bottom of the container upwardly through the bottom wall into the air chamber 86 and then out through the side wall 78 terminating in a spout 100. The spout 100 includes a sleeve-like portion 102 for receiving the upper end of the fluid tube and securing it therein in a manner so as to prevent the leakage of air from the air chamber 86 through the spout. The sleeve and fluid tube may be glued or welded in a well known manner or the tolerances may be so close as to form a secure fluid seal.

The disk 90 is provided with an air channel 114 for permitting the entry of air into the air chamber and a valve stem 116 is secured to the disk adjacent the air channel. An opening 118 is provided through the bottom portion 94 and the valve stem passes therethrough. A flared cylindrical valve 120 is provided on the lower end of the valve stem beneath bottom portion 94 for sealing opening 118 in the unactuated position illustrated in FIG. 3. If desired, an O-ring may be provided immediately above the valve 120 on the stem 116.

In operation the second embodiment performs in substantially the same way as the first embodiment.

That is, the user places his index finger or thumb over the air channel 114 and depresses the disk downwardly against the bias of spring 112. This forces the air in chamber 86 into the interior of container 70 through the opening 118 which is accessible by virtue of the movement of the valve away from the opening. The air pressure forces fluid out of the container through the fluid tube 98 and the spout 100. At the end of the pump stroke air channel 114 is unblocked and spring 112 returns the disk to the FIG. 3 position.

In the foregoing description the FIG. 1 embodiment was disclosed as being for a wide mouth container and employing a valve and O-ring with a screw cap provided thereon while the second embodiment was described as a simple cylindrical valve blocking the opening to the air chamber. It will be readily apparent to those skilled in the art that both of these valve arrangements are suitable for use in either of the first two embodiments disclosed herein and the pump units themselves can be utilized with insulated or uninsulated containers. The important feature of the invention is the ability to prevent liquid from entering the air chamber to insure a clean, trouble free pumping mechanism.

Figure 5:
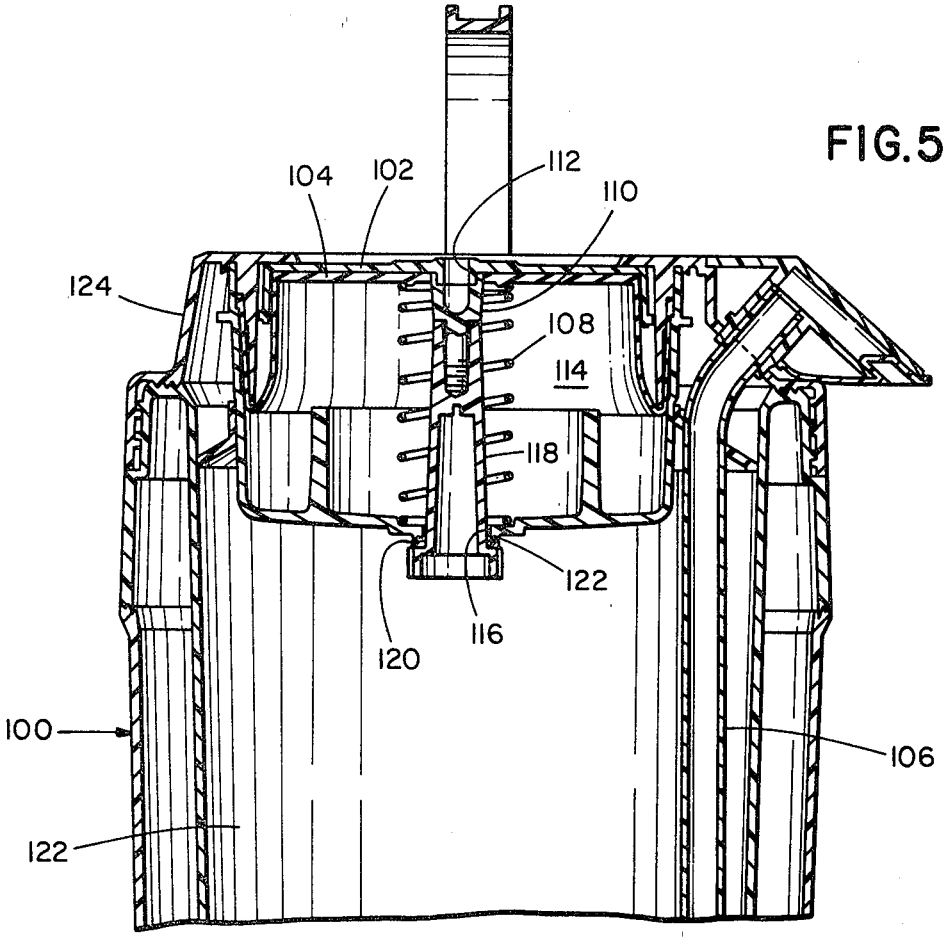
FIG. 5 is a cross-sectional view of a pump dispenser according to a third embodiment.
Figure 6:
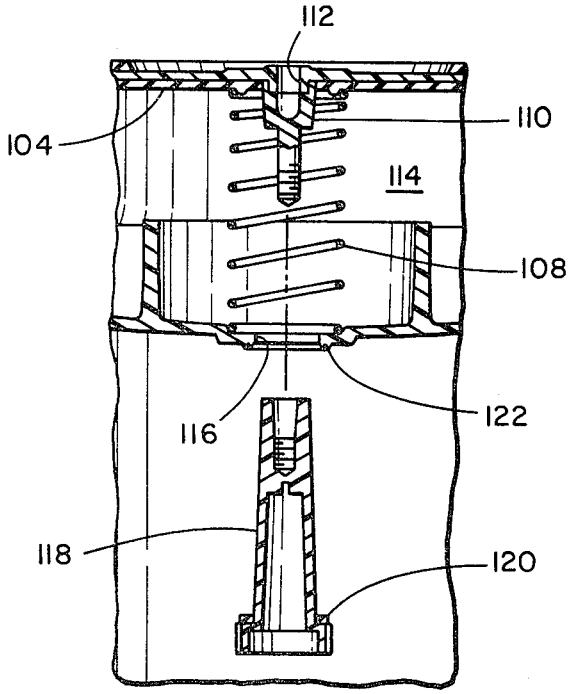
FIG. 6 is a partial cross-sectional view illustrating the removal of the sealing nut of the FIG. 5 embodiment.

Referring now to FIGS. 5 and 6, a third embodiment of the invention is illustrated. This embodiment is similar in design to the first two embodiments but is particularly adapted for use with hot liquids which have a tendency to generate steam pressure. Insulated bottles are often utilized for carrying hot coffee or other beverages which can generate sufficient pressure within the insulated container to cause a "self-pumping" action whereby fluid passes out the fluid tube without operation of the pumping means. This phenomenon is undesirable in that hot beverages can cause damage to fabrics and/or injury to a user.

The embodiment of FIGS. 5 and 6 employs a removable valve assembly which can be selectively utilized depending upon the temperature of the liquids to be dispensed from the container. When hot liquids are to be dispensed the valve assembly is removed permitting the steam from the liquid to be vented through the pump unit thereby avoiding pressure build up which could lead to the self-pumping action described.

As illustrated in FIGS. 5 and 6, the third embodiment is shown in conjunction with a wide mouth vacuum bottle 100. It will be apparent, based on the preceding descriptions, that this unit could also be employed with a narrow mouth bottle. The pump unit is provided with a disk 102, a flexible diaphragm 104 and a fluid tube 106 as with the preceding embodiments. A spring 108 serves to bias the disk and diaphragm to the FIG. 5 position in the absence of manual pressure on the disk.

As best seen in FIG. 6, attached to and extending downwardly from the disk 102, is a threaded valve stem 110. Valve stem 110 at its upper portion includes an air passage communicating with the opening 112 in the disk to permit air to enter or leave the pump interior 114. An opening 116 is provided in the bottom of the pump housing through which air passes during operation of the pump.

A removable valve assembly 118 is provided which is threadingly engaged on the valve stem 110 as illustrated in FIG. 5. As with the preceding embodiments, the valve assembly seals the opening 116 except when the disk and diaphragm are depressed for the purpose of pumping liquid. A good seal over the opening is insured by use of a flexible washer 120 concentrically mounted on the lower portion of the valve assembly. In order to insure a tight seal between the washer and the bottom of the housing, the latter may be provided with downwardly extending circular serrations or ridges 122 to increase the pressure against the washer 120 in the unoperated condition illustrated in FIG. 5.

As with the previous embodiments, when the valve assembly is secured to the valve stem, the enclosed space 114 is protected against leakage of fluid from the vacuum bottle. When, however, it is expected that hot fluids will be carried in the vacuum bottle the valve assembly 118 is unscrewed from the valve stem 110 and removed from the assembly. This provides a vent path for steam generated by the hot liquids through opening 116, enclosed space 114 and out the passage 112. This vent pathway prevents a pressure build up in the container interior which could cause self-pumping. When the valve assembly is removed, of course, there is no protection against fluid entering the pump housing. However, the housing can be cleaned after use through openings 112 and 116.

Where the pump is intended for use with hot beverages which have a tendency to generate steam, the thermal insulating properties of the container and pump can be improved by the addition of a vapor shield 123 illustrated in FIG. 5. This shield forms a contact surface for the rising vapor and acts as a barrier against the vapor passing upwardly to a point beyond the insulated walls of the container. The vapor which condenses on the shield eventually drops downwardly back into the container and cannot reach, for example, the outer portion 124 of the housing which is uninsulated.

Figure 7:
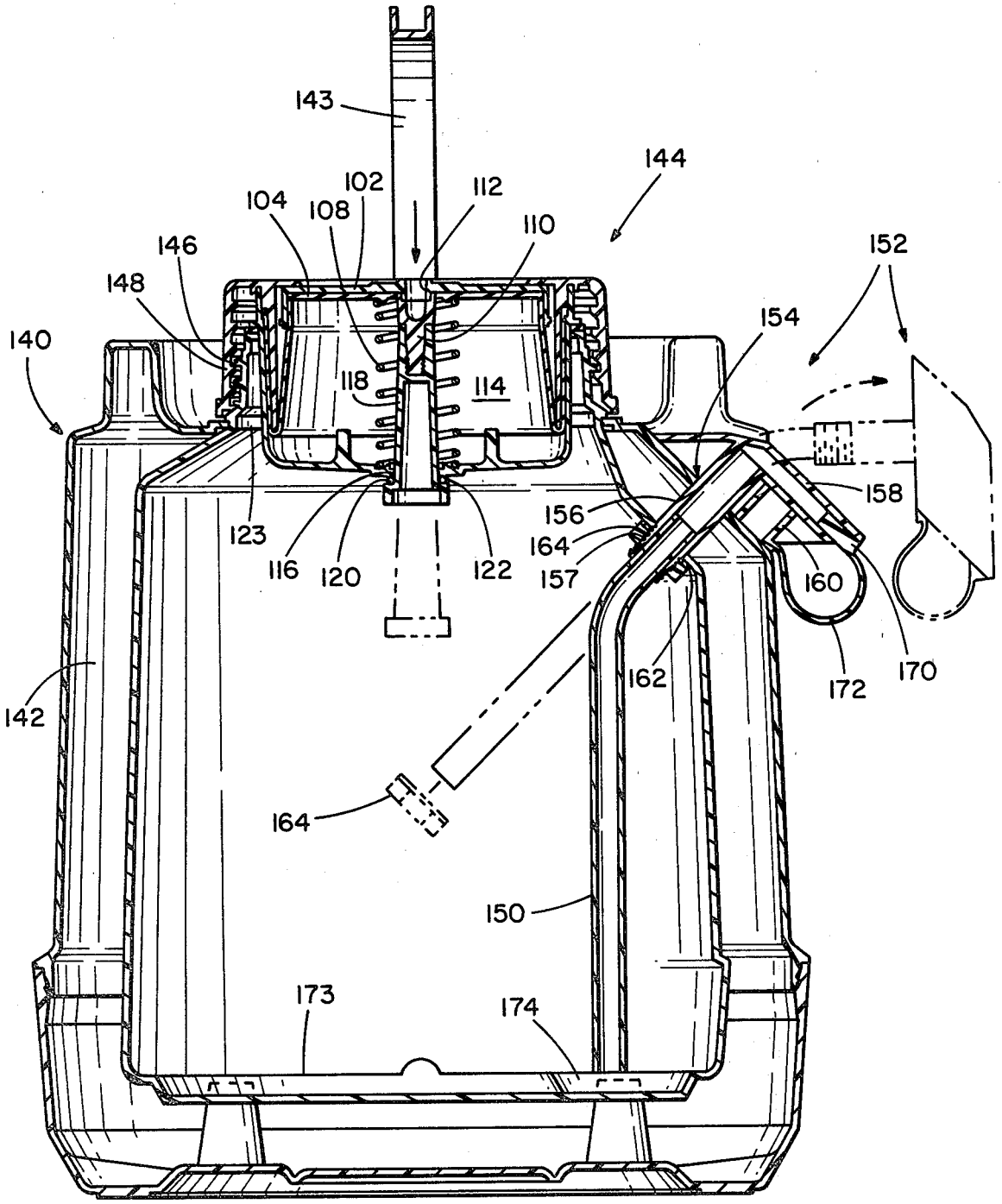
FIG. 7 is a cross-sectional view of a pump dispenser according to the fourth embodiment of the invention adapted for a large container having its own fluid tube.

Referring now to FIG. 7, a fourth embodiment of the invention is illustrated. This embodiment is substantially similar to the embodiment of FIG. 5 and, for convenience, the same reference numerals have been used where possible. The FIG. 7 embodiment is particularly adapted for use on large insulated containers having their own fluid tube or other discharge means by which fluid can be dispensed from the insulated interior. The container illustrated in FIG. 7 is a large "jug" type and, for example, may have a liquid carrying capacity of one-half gallon, one gallon or more, as desired. The jug 140 is double walled having insulating material provided in the space 142 between the walls. A handle 143 permits carrying of the jug. The pump unit 144 is secured to the top of the jug in any convenient manner as, for example, by means of threads 146 provided on the opening which mate with corresponding threads 148 on the pump housing.

The interior construction of the pump dispenser 144 is substantially identical to that shown and described in connection with FIGS. 5 and 6. Accordingly, no further detailed description of the pump unit is believed necessary. Of course, the dimensions of the pump 144 will differ depending upon the size of the container for which it is adapted. A large container permits a larger pump unit to be used therewith producing a greater displacement of fluid per pump stroke.

As with the FIG. 5 embodiment, the pump is provided with a removable valve assembly 118 which is threadably or otherwise engaged on the valve stem 110 attached to the force applying disk 102. The pump unit also includes a vapor shield 123 to reduce heat loss.

Unlike the FIG. 5 embodiment, the pump housing does not carry a fluid tube assembly. In this embodiment the fluid tube 150 is attached to a spout assembly 152 which is removably secured to the container 140 through an opening 154 therein. The spout assembly includes a collar or sleeve 156, a spout 158, and a standoff 160. The collar portion is a hollow cylinder in cross-section and of sufficient length to pass through the walls of the container through the opening 154. The fluid tube 150 is received in the lower end of the collar and may be press fit, glued or otherwise secured thereto.

Preferably, the spout assembly and fluid tube are removably secured to the container so that they may be withdrawn for cleaning when necessary as indicated by the phantom view. According to a preferred method, the lower portion of the collar 156 is provided with threads 157. This permits the use of a washer 162 and a plastic nut 164 to secure the fluid tube and spout assembly in position on the container. As the threads of the nut 164 are tightened the standoff 160 is drawn down onto the outer wall of the container correctly positioning the assembly for use.

The fluid tube communicates the interior of the container with the outside via a spout 158. A stopper 170 dimensioned to fit within the spout may be provided on a retainer strap 172 attached to the standoff. This prevents the possibility of fluid leaking from the container in the event it is stored on its side.

As with the previous embodiments, the fluid tube extends to a point near the bottom 173 of the container. If the container bottom is provided with a recess or channel 174, the tube can extend to a point at or below the bottom 173 thereby insuring the removal of substantially all fluid from the container by the pumping mechanism.

While I have shown and described embodiments of this invention in some detail, it will be understood that this description and illustrations are offered merely by way of example, and that the invention is to be limited in scope only by the appended claims.

We claim:

1. A pump dispenser suitable for attachment to the pouring opening of a hot or cold liquid container to dispense liquids from the container interior comprising:

(a) an air chamber, (b) means for pumping air from said chamber through an opening therein into the container interior, said pumping means including a diaphragm and means for displacing said diaphragm, (c) valve means positioned in liquid sealing relation over said opening and operatively connected to said displacing means for displacement away from said opening only during pumping of air from said chamber into said container whereby said chamber is normally sealed against the entry of liquid from said container through said opening wherein said valve means includes:

a valve stem disposed within said air chamber, one end thereof connected to said displacing means, a removable valve assembly which is adapted to be selectively extended through said opening into said air chamber to permit said assembly to be secured to the other end of said valve stem, said assembly when secured, except during pumping, being positioned in sealing relation over said opening, but when said assembly is not secured to said valve stem a venting path through said air chamber is provided to permit the storing of hot liquids.

2. The device according to claim 1 wherein said valve stem and valve assembly are provided with screw threads and said valve assembly is threadingly engaged on said stem.

3. The device according to claim 2 wherein said valve assembly includes a resilient washer normally maintained in sealing relation over said opening, said air chamber having means concentrically disposed around said opening for ensuring maintenance of said washer in said sealing relation.

4. The dispenser according to claim 1 wherein said dispenser further includes a fluid tube to conduct the liquid displaced by said air out of the container.

* * * * *